US006352670B1

(12) United States Patent
Rakowski

(10) Patent No.: US 6,352,670 B1
(45) Date of Patent: Mar. 5, 2002

(54) OXIDATION AND CORROSION RESISTANT AUSTENITIC STAINLESS STEEL INCLUDING MOLYBDENUM

(75) Inventor: James M. Rakowski, Pittsburgh, PA (US)

(73) Assignee: ATI Properties, Inc., Wilmington, DE (US)

( * ) Notice: Subject to any disclaimer, the term of this patent is extended or adjusted under 35 U.S.C. 154(b) by 0 days.

(21) Appl. No.: 09/641,316

(22) Filed: Aug. 18, 2000

(51) Int. Cl.[7] ..... C22C 38/44; C22C 38/50; C22C 30/00

(52) U.S. Cl. ..... 420/53; 420/52; 420/49; 148/327

(58) Field of Search ..... 420/49, 52, 53, 420/586.1; 148/605, 327

(56) References Cited

U.S. PATENT DOCUMENTS

| | | | |
|---|---|---|---|
| 4,012,227 | A | 3/1977 | Jones et al. |
| 4,014,680 | A | 3/1977 | Reen |
| 4,041,274 | A | 8/1977 | Sadowski |
| 4,086,085 | A | 4/1978 | McGurty |
| 4,248,629 | A | 2/1981 | Pons et al. |
| 4,505,232 | A | 3/1985 | Usami et al. |
| 4,675,156 | A | 6/1987 | Sakamoto et al. |
| 5,827,377 | A | 10/1988 | Crum et al. |
| 4,784,831 | A | 11/1988 | Mankins et al. |
| 5,021,215 | A | 6/1991 | Sawaragi et al. |
| 5,160,389 | A | 11/1992 | Akiyama et al. |
| 5,569,334 | A | 10/1996 | Kawata et al. |
| 5,620,805 | A | 4/1997 | Ogawa et al. |
| 6,060,180 | A | 5/2000 | Ishitsuka et al. |

*Primary Examiner*—Deborah Yee
(74) *Attorney, Agent, or Firm*—P. J. Viccaro

(57) ABSTRACT

An austenitic stainless steel comprising, by weight, 17 to 23% chromium, 19 to 23% nickel, 1 to 6% molybdenum. The addition of molybdenum to the iron-base alloys of the invention increases their resistance to corrosion. The austenitic stainless steel may consisting essentially of, by weight, 17 to 23% chromium, 19 to 23% nickel, 1 to 6% molybdenum, 0 to 0.1% carbon, 0 to 1.5% manganese, 0 to 0.05% phosphorus, 0 to 0.02% sulfur, 0 to 1.0% silicon, 0.15 to 0.6% titanium, 0.15 to 0.6% aluminum, 0 to 0.75% copper, iron, and incidental impurities. Austenitic stainless steels according to the present invention exhibit enhanced resistance corrosion by salt at a broad temperature range up to at least 1500° F. Thus, the stainless steel of the present invention would find broad application as, for example, automotive components and, more particularly, as automotive exhaust system components and flexible connectors, as well as in other applications in which corrosion resistance is desired.

7 Claims, 7 Drawing Sheets

OXIDATION AND CORROSION RESISTANT AUSTENITIC STAINLESS STEEL INCLUDING MOLYBDENUM

CROSS-REFERENCE TO RELATED APPLICATIONS

Not Applicable

FEDERALLY SPONSORED RESEARCH

Not Applicable

TECHNICAL FIELD AND INDUSTRIAL APPLICABILITY OF THE INVENTION

The present invention relates to an oxidation and corrosion resistant austenitic stainless steel. More particularly, the present invention relates to an austenitic stainless steel adapted for use in high temperature and corrosive environments, such as, for example, use in automotive exhaust system components. The austenitic stainless steel of the invention finds particular application in components exposed to temperatures up to 1800° F. and to corrosive environments, such as, for example, chloride-rich waters.

DESCRIPTION OF THE INVENTION BACKGROUND

In the manufacture of automotive exhaust system components, concurrent goals are to minimize both cost and weight, while also maintaining the integrity of the system. Typically, automobile components for these applications are fabricated from thin stainless steel stock in order to minimize the weight of the components and, therefore, the components' resistance to corrosive attack must be high to prevent failure by perforation or other means. Corrosion resistance is complicated by the fact that components used for certain automotive exhaust system applications are exposed to severely corrosive chemical environments at elevated temperatures. In particular, automotive exhaust system components and other automotive engine components are exposed to contamination from road deicing salts under conditions of elevated temperature due to the hot exhaust gases. The stainless steel and other metal components subjected to these conditions are susceptible to a complex mode of corrosive attack known as hot salt corrosion.

Typically, at higher temperatures, stainless steel components undergo oxidation on surfaces exposed to air to form a protective metal oxide layer. The oxide layer protects the underlying metal and reduces further oxidation and other forms of corrosion. However, road deicing salt deposits may attack and degrade this protective oxide layer. As the protective oxide layer is degraded, the underlying metal may be exposed and become susceptible to severe corrosion.

Thus, metal alloys selected for automotive exhaust system components are exposed to a range of demanding conditions. Durability of automotive exhaust system components is critical because extended lifetimes are demanded by consumers, by federal regulations, and also under manufacturers' warranty requirements. To further complicate alloy selection for automotive exhaust system components, a recent development in these applications is the use of metallic flexible connectors, which act as compliant joints between two fixed exhaust system components. Flexible connectors may be used to mitigate problems associated with the use of welded, slip, and other joints. A material chosen for use in a flexible connector is subjected to a high temperature corrosive environment and must be both formable and have resistance to hot salt corrosion and various other corrosion types, such as, for example, intermediate temperature oxidation, general corrosion, and chloride stress corrosion cracking.

Alloys for use in automotive exhaust system flexible connectors often experience conditions in which elevated temperature exposure occurs after the alloy has been exposed to contaminants such as road deicing salts. Halide salts can act as fluxing agents, removing the protective oxide scales which normally form on the connectors at elevated temperatures. Degradation of the connectors may be quite rapid under such conditions. Therefore, simple air oxidation testing may be inadequate to reveal true resistance to corrosive degradation in service.

The automotive industry uses several alloys for manufacturing automotive exhaust system components. These alloys range from low cost materials with moderate corrosion resistance to high cost, highly alloyed materials with much greater corrosion resistance. A relatively low cost alloy with moderate corrosion resistance is AISI Type 316Ti (UNS Designation S31635). Type 316Ti stainless steel corrodes more rapidly when exposed to elevated temperatures and, therefore, is not generally used in automotive exhaust system flexible connectors when temperatures are greater than approximately 1200° F. Type 316Ti is typically only used for automotive exhaust system components which do not develop high exhaust temperatures.

Higher cost, more highly alloyed materials are commonly used to fabricate flexible connectors for automotive exhaust systems exposed to higher temperatures. A typical alloy used in the manufacture of flexible connectors that are subjected to elevated temperature corrosive environments is the austenitic nickel-base superalloy of UNS Designation N06625, which is sold commercially as, for example, ALLEGHENY LUDLUM ALTEMP® 625 (hereinafter "AL 625"). AL 625 is an austenitic nickel-based superalloy possessing excellent resistance to oxidation and corrosion over a broad range of corrosive conditions and displaying excellent formability and strength. Alloys of UNS Designation N06625 generally comprise, by weight, approximately 20–25% chromium, approximately 8–12% molybdenum, approximately 3.5% niobium, and 4% iron. Although alloys of this type are excellent choices for automotive exhaust system flexible connectors, they are quite expensive compared to Type 316Ti alloys and other iron-based alloys.

Automotive exhaust system component manufacturers may use other alloys for constructing exhaust system flexible connectors. However, none of those alloys provide high corrosion resistance, especially when exposed to elevated temperatures and corrosive contaminants such as road deicing salts.

Thus, there exists a need for a corrosion resistant material for use in high temperature corrosive environments that is not as highly alloyed as, for example, alloys of UNS Designation N06625 and which, therefore, is less costly to produce than such superalloys. More particularly, there exist a need for an iron-base alloy which may be formed into, for example, light-weight flexible connectors and other components for automotive exhaust systems and which will resist corrosion from corrosive substances such as salt deposits and other road deicing products at elevated temperatures.

SUMMARY OF THE INVENTION

The present invention addresses the above described needs by providing an austenitic stainless steel comprising, by weight, 17 to 23% chromium, 19 to 23% nickel, and 1 to 6% molybdenum. The addition of molybdenum to the iron-base alloys increases their resistance to corrosion at high temperatures.

The present invention also provides an austenitic stainless steel consisting essentially of, by weight, 17 to 23% chromium, 19 to 23% nickel, 1 to 6% molybdenum, 0 to 0.1% carbon, 0 to 1.5% manganese, 0 to 0.05% phosphorus, 0 to 0.02% sulfur, 0 to 1.0% silicon, 0.15 to 0.6% titanium, 0.15 to 0.6% aluminum, 0 to 0.75% copper, iron, and incidental impurities.

Austenitic stainless steels according to the present invention exhibit enhanced resistance corrosion by salt at a broad temperature range up to at least 1500° F. Articles of manufacture of the austenitic stainless steel as described above are also provided by the present invention. Thus, the stainless steel of the present invention would find broad application as, for example, automotive components and, more particularly, as automotive exhaust system components and flexible connectors, as well as in other applications in which corrosion resistance is desired. The alloy of the present invention exhibits excellent oxidation resistance at elevated temperatures and, therefore, finds broad application in high temperature applications, such as for heating element sheaths. The present invention also provides methods of fabricating an article of manufacture from the austenitic stainless steels comprising, by weight, 17 to 23% chromium, 19 to 23% nickel, and 1 to 6% molybdenum.

The reader will appreciate the foregoing details and advantages of the present invention, as well as others, upon consideration of the following detailed description of embodiments of the invention. The reader also may comprehend such additional details and advantages of the present invention upon making and/or using the stainless steels of the present invention.

BRIEF DESCRIPTION OF THE FIGURES

The features and advantages of the present invention may be better understood by reference to the accompanying figures in which.

DETAILED DESCRIPTION OF EMBODIMENTS OF THE INVENTION

Figure 1:
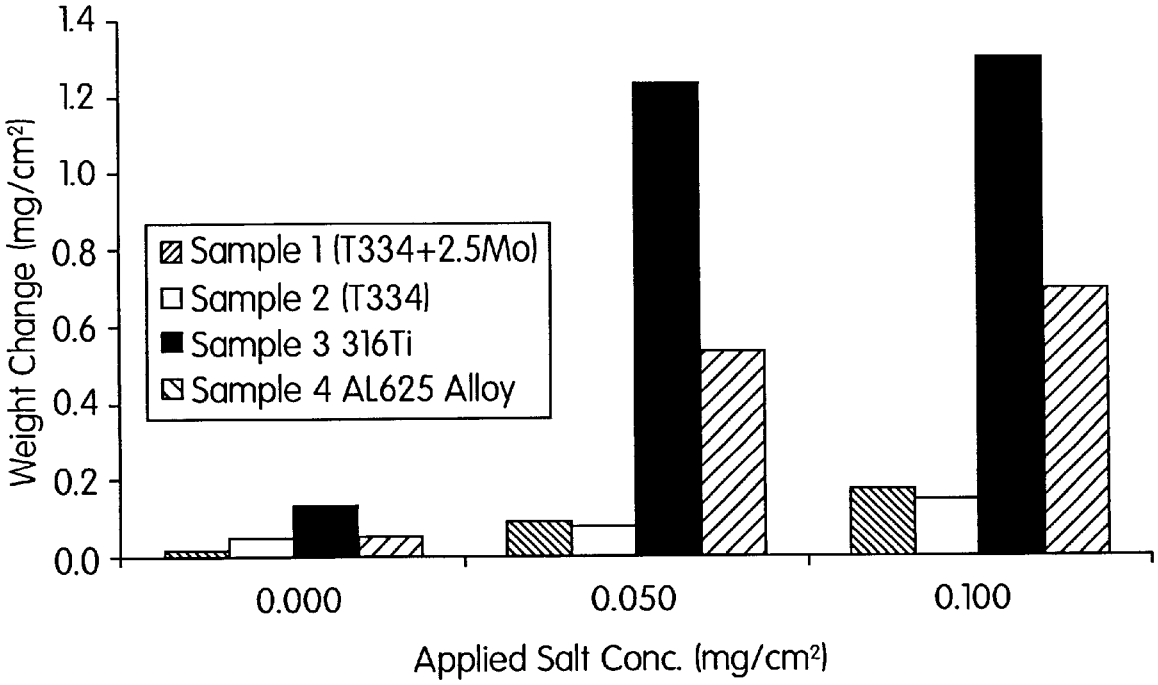
FIG. 1 is a graph of weight change data comparing the results of hot salt corrosion testing of flat coupon samples of an alloy of the present invention (Sample 2) and prior art alloys coated with 0.0, 0.05 and 0.10 mg/cm$^2$ salt layers and exposed for 72 hours to 1200° F.

The present invention provides an austenitic stainless steel resistant to corrosion at elevated temperatures. The corrosion resistant austenitic stainless steel of the present invention finds particular application in the automotive industry and, more particularly, in automotive exhaust system components. Austenitic stainless steels are alloys including iron, chromium and nickel. Typically, austenitic stainless steels are used in applications requiring corrosion resistance and are characterized by a chromium content above 16% and nickel content above 7%.

In general, the process of corrosion is the reaction of a metal or metal alloy with their environment. The corrosion of metal or alloy in a particular environment is generally determined at least partly by its composition, among other factors. The byproducts of corrosion are generally metal oxides such as iron oxides, aluminum oxides, chromium oxide, etc. The formation of certain oxides, particularly chromium oxide, on stainless steel is beneficial and effectively prevents further degradation of the underlying metal. Corrosion may be accelerated by the presence of heat or corrosive agents.

Corrosion resistance of stainless steels used in automotive applications is complicated by exposure to contamination from road deicing salts under conditions of elevated temperature. This exposure results in a complex form of corrosion due to the interaction between the oxides which form at elevated temperatures and the contaminating salts. Elevated temperature oxidation is typified by the formation of protective oxides by reaction of the metal directly with the oxygen in the air. The road deicing salts which deposit on the automotive components may attack and degrade the protective oxide layer. As the protective layer degrades, the underlying metal is exposed to further corrosion. Halide salts, particularly chloride salts, tend to promote localized forms of attack such as pifting or grain boundary oxidation. The present invention provides an austenitic stainless steel that resists hot salt corrosion.

The present austenitic stainless steel includes 1 to 6% molybdenum by weight. Molybdenum is added as an alloying agent to provide corrosion resistance, toughness, strength, and resistance to creep at elevated temperatures. The austenitic stainless steel of the present invention also includes 17 to 23 weight percent chromium, 19 to 23 weight percent nickel and less than 0.8 weight percent silicon. The present austenitic stainless steel provides better elevated temperature corrosion resistance than the prior art type 31 6Ti alloys and, therefore, would enjoy more generalized application as an automotive exhaust component. However, the present invention provides this corrosion resistance at a lower cost than the UNS Designation N06625 alloys because, for example, the present invention is an iron-base alloy, while the N06625 alloys are more expensive nickel-base superalloys.

The austenitic stainless steel of the present invention preferably contains greater than 2 weight percent of molybdenum. Another preferred embodiment of the present invention includes less than 4 weight percent molybdenum. This concentration of molybdenum provides improved corrosion resistance at a reasonable cost. The present invention may optionally contain additional alloying components, such as, for example, carbon, manganese, phosphorous, sulfur, and copper. The stainless steel of the present invention also may contain, for example, from 0.15 to 0.6 weight percent titanium, 0.15 to 0.6 weight percent aluminum, and other incidental impurities.

Electric heat element sheaths typically comprise a resistance conductor enclosed in a metal sheath. The metal sheath preferably provides oxidation resistance at high temperatures. The resistance conductor may be supported within and electrically insulate from the sheathing by a densely packed later of refractory, heat-conducting material. The resistance conduction may generally be a helically wound wire member while the refractory heat conducting material may be granular magnesium oxide.

Stainless steels of the present invention were prepared and evaluated for resistance to corrosion in high temperature, corrosive environments. A heat was melted with a target composition including, by weight, 17 to 23% chromium and 19 to 23% nickel. This alloy of the present invention, also, had a target molybdenum concentration of 2.5%. The actual composition of the finished alloy is shown in Table 1 as Sample 1. The alloy of Sample 1 was prepared by a conventional method, specifically, by vacuum melting the alloy components in concentrations to approximate the target specification. The formed ingots were then ground and hot rolled at approximately 2000° F. to about 0.1 inches thick by 7 inches wide. The resulting plate was grit blasted and descaled in an acid. The plate was then cold rolled to a thickness of 0.008 inches and annealed in inert gas. The resulting plate was formed into both flat coupon and welded teardrop samples.

For comparison, additional commercially available alloys were obtained and formed into flat coupon and welded teardrop samples. Sample 2 was melted to specifications of a commercially available AISI Type 334 (UNS Designation S08800) alloy. Type 334 is an austenitic stainless steel characterized by a composition similar to that of Sample 1, but includes no deliberately added molybdenum. Type 334 is, generally, a nickel and chromium stainless steel designed to resist oxidation and carburization at elevated temperatures. The analysis of the Type 334 sample tested is shown in Table 1. Type 334 typically characterized as our alloy comprising approximately 20 weight percent nickel and approximately 19 weight percent chromium. Type 334 was chosen for comparison purposes to determine the improvement offered by the addition of molybdenum in Sample 1 to the corrosion resistance in hot salt corrosion testing.

Also tested for comparison purposes were samples of AISI Type 316Ti (UNS Designation S31635) (Sample 3) and AL 625, (UNS Designation N06625) (Sample 4). These two alloys are currently employed in flexible connectors for automotive exhaust systems because they are formable and resist intermediate temperature oxidation, general corrosion, and chloride stress corrosion cracking, particularly in the presence of high levels of road contaminants such as deicing salts. The composition of Samples 3 and 4 are shown in Table 1. AISI Type 316Ti is a low cost alloy presently used in low temperature automotive exhaust system flexible connector applications. AL 625, on the other hand, is a higher cost material which presently finds broad application, including use as automotive exhaust system flexible connectors subjected to temperatures in excess of 1500° F.

TABLE 1

Composition of Tested Alloys

| | Sample 1 T334 + 2.5 Mo | Sample 2 T334 | Sample 3 T316Ti | Sample 4 AL625 Alloy |
|---|---|---|---|---|
| C | 0.018 | 0.014 | 0.08 max | 0.05 |
| N | 0.016 | 0.014 | 0.10 max | — |
| Al | 0.29 | 0.28 | — | 0.30 |
| Si | 0.58 | 0.57 | 0.75 max | 0.25 |
| Ti | 0.53 | 0.49 | 0.70 | 0.30 |
| Cr | 19.48 | 18.75 | 16–18 | 22.0 |
| Mn | 0.51 | 0.54 | 2 max | 0.30 |
| Fe | Balance | Balance | Balance | 4.0 |
| Ni | 19.91 | 18.67 | 10–14 | Balance |
| Nb + Ta | — | — | — | 3.5 |
| Mo | 2.47 | — | 2–3 | 9.0 |

A test was devised to examine the elevated temperature corrosion and oxidation resistance of the above samples in the presence of deposited corrosive solids. Special corrosion tests have been developed to simulate these high temperature corrosive environments. Currently, most testing of alloy resistance to corrosion from salt at elevated temperatures can be categorized as a "cup" test or a "dip" test.

In the cup test a sample of alloy is placed in a cup, generally of Swift or Erichsen geometry. The cup is then filled with a known volume of aqueous test solution having known salt concentration. The water in the cup is evaporated in an oven, leaving a salt coating on the sample. The sample is then exposed to elevated temperature under either cyclic or isothermal conditions and the sample's resistance to salt corrosion is assessed. In the dip test a sample, either flat or in a U-bend configuration, is dipped in an aqueous solution having known salt concentration. The water is evaporated in an oven, leaving a coating of salt on the sample. The sample may then be assessed for resistance to salt corrosion.

There are, however, problems with both of the above tests to determine resistance to corrosion from salt. The results of the test may be inconsistent and not easily compared from test to test because the salt coating is not evenly distributed across the extent of the surface to be tested or consistent between samples. Using either the cup or dip tests, salt will generally be deposited most heavily in the areas which are last to dry. In order to impose a more uniform deposition of salt on the samples, a simple salt application method was utilized by the present inventor. The method comprised spraying an aqueous salt solution on a flat sample. An even layer of salt may be deposited from an aerosol spray consisting essentially of sodium chloride dissolved in deionized water using this method. During deposition of the aerosol spray, the samples are heated to approximately 300° F. to ensure rapid, uniform evaporation of the water from the aqueous solution. The amount of salt deposited is monitored by weighing between sprays, and is reported as a surface concentration (mg salt/cm$^2$ surface area of sample). Calculations indicate that the salt deposition may be controlled by careful use of this method to approximately ±0.01 mg/cm$^2$. After spraying, the samples may be exposed to at least one 72-hour thermal cycle at an elevated temperature in a muffle furnace in still lab air or any other environmental conditions as desired. Preferably, a dedicated test furnace and labware should be used for this test in order to avoid cross-contamination from other test materials. After exposure, the samples and any collected non-adherent corrosion products are independently weighed. The results are reported as a specific weight, change relative to the original (uncoated) specimen weight as previously described.

Flat coupons were initially tested since this is the simplest method to screen alloys for susceptibility to hot salt corrosion. The weight of each sample was determined before testing. An even layer of salt was applied to 1 inch by 2 inch test samples of each test alloy. A dilute aqueous solution of chloride salts dissolved in deionized water was sprayed on each such sample. The samples were preheated to approximately 300° F. on a hot plate to ensure rapid, uniform evaporation of the water from the solution. The amount of salt deposited on each sample was monitored by weighing after each spraying. After spraying, the samples were placed in high form alumina crucibles and exposed in a muffle furnace to elevated temperatures to 1500° F. The typical exposure cycle was 72 hours at the elevated temperature in still lab air. After exposure the specimens were weighed. Any non-adherent corrosion products were collected and weighed separately. Any calculated weight gains or losses of the samples are due to the reaction of metal species with the atmosphere and any remaining salt from the coating. The amount of applied salt is generally much less than the weight change due to interaction with the environment, and as such can generally be discounted.

The effects of residual stresses resulting from forming or welding were also investigated. For this test, samples were formed into welded "teardrop" samples. The "teardrop" samples were fabricated by bending 0.062" thick flat samples into a teardrop shape on a jig and then autogenously welding the mating edges. Prior to exposure to the elevated temperatures, the samples were coated with chloride salts using a method similar to that described for coating the flat samples. The coatings on the teardrops were not applied in a quantitative manner. However, the result of coating was an even, uniform deposition of salt. It is estimated that the amount of salt deposited on the outer surface of the teardrop samples was nominally 0.10 mg/cm$^2$ The coated specimens were exposed in the automated thermogravimetric cyclic oxidation laboratory setup. Every 24 hours the salt coating on each sample was removed by evaporation and the samples were then weighed so as to determine weight loss or gain caused by exposure to the environment. After weighing, the salt coatings were reapplied and the test was continued. Table 2 summarizes the tests carried out on each of Samples 1 through 5.

TABLE 2

Test specimen stock identification matrix

| | Grade | Coupon testing | Teardrop testing |
|---|---|---|---|
| Sample 1 | Present Invention | 0.008" thick | 0.061" thick |
| Sample 2 | T-332 | 0.008" thick | 0.058" thick |
| Sample 3 | T-316Ti | 0.008" thick | 0.062" thick |
| Sample 4 | AL625 | 0.008" thick | 0.059" thick |

Results From Corrosion Testing

Flat coupon testing was used to provide an initial measure of performance and then welded teardrop tests were tested to confirm flat coupon testing and expand the test results.

Flat Coupon Testing Results

Testing was conducted of flat coupon samples of four test materials, samples 1 through 4 listed in Table 1, to determine the affect of increased salt concentrations and increased temperatures on the corrosion resistance of the alloy. Coupons of each composition for samples 1 through 4 listed in Table 1 were tested with no added salt coating and salt coatings of 0.05 mg/cm$^2$ and 0.1Omg/cm$^2$. The coupons were tested at two temperatures, 1200° F. and 1500° F. The samples were weighed prior to being coated with salt to determine their initial weight and then coated with the appropriate amount of salt for each test and placed in a 1200° F. environment to determine the resistance of each alloy to hot salt oxidation corrosion. After 72 hours of exposure to the elevated temperature, the samples were removed from the oven and allowed to cool to room temperature. The salt remaining on the sample was removed and the sample was weighed to determine the final weight of the sample.

The results of the flat coupon sample hot salt oxidation corrosion test are shown in FIG. 1. FIG. 1 is a graph of weight change data comparing the results of hot salt corrosion testing of flat coupon samples of an alloy of the present invention (Sample 1) and prior art alloys coated with 0.0, 0.5 and 0.10 mg/cm$^2$ salt layers and exposed for 72 hours to 1200° F. The change in weight was determined by subtracting the initial weight of the sample by the final weight of the sample and, then, dividing this result by the initial surface area of the flat coupon sample.

All alloys performed well in this test at 1200° F. The sample of each alloy showed a slight weight gain indicating the formation of an adherent oxidation layer. The formation of this metal oxide layer protects the body of the material if it remains adherent to the surface of the metal. Generally, the samples showed a greater weight gain with an increase in level of salt coating. This results indicate increased levels of oxidation on the surface of the sample with increased salt concentrations. T316Ti, Sample 3, showed the greatest weight gain of over 1 mg/cm$^2$ while the alloy of the present invention, Sample 1, and the T334, Sample 2 showed the least weight gain of less than 0.3 mg/cm$^2$.

Figure 2:
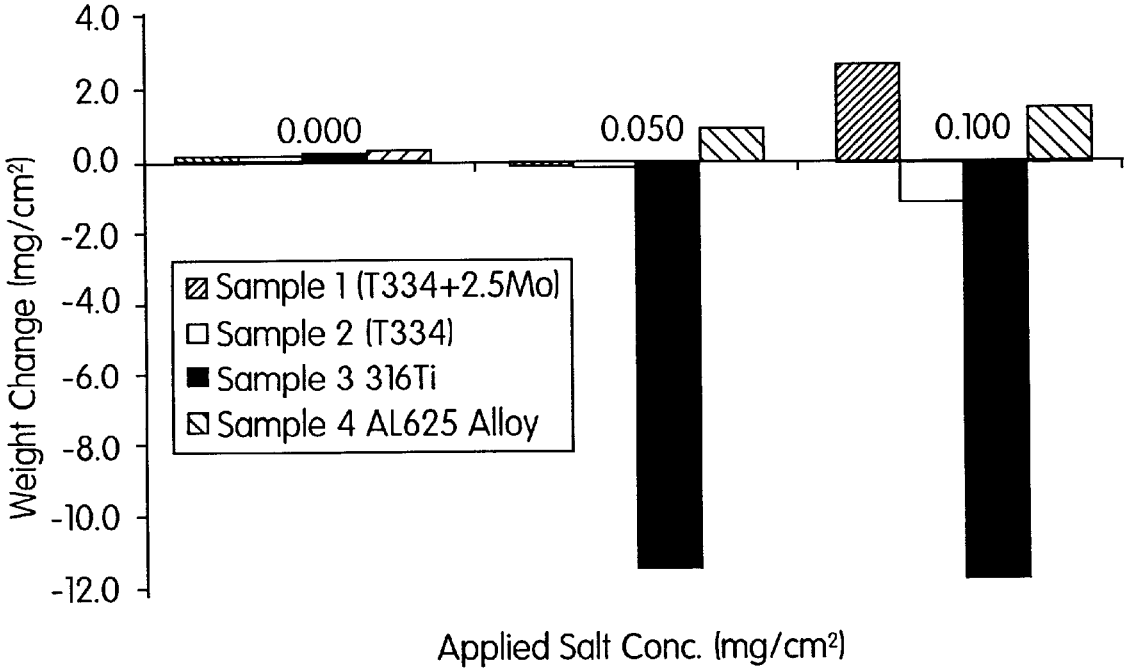
FIG. 2 is a graph of weight change data comparing the results of hot salt corrosion testing of flat coupon samples of an alloy of the present invention (Sample 2) and prior art alloys coated with 0.0, 0.05 and 0.10 mg/cm$^2$ salt layers and exposed for 72 hours to 1500° F.

A similar test was conducted on the samples of the same alloys at 1500° F. and the results are shown in FIG. 2. The low temperature application alloy application T-316Ti performed poorly, as expected. Heavy spalling was noted and the coupons coated with 0.05 and 0.10 mg/cm$^2$ lost over 10 mg per square centimeter of initial surface area. This test confirmed that T-316Ti is unsuitable for use in elevated temperature applications, above 1200° F., and confirmed the reliability of the test method developed for comparing resistance of the alloys to hot salt oxidation. All other tested alloys performed well. T-334, Sample 2, showed weight loss of about 1.5 mg/cm$^2$ under the test conditions. The higher cost AL625 superalloy, Sample 4, exhibited a weight gain of approximately 1.7 mg/cm$^2$ under these test conditions. This weight gain is consistent with the formation of the protective layer of metal oxides on the surface of the alloy and minimal spalling of this protective layer. The alloy of the present invention, Sample 1, exhibited almost no weight change with no salt coating and with a 0.05 mg/cm$^2$ salt coating with a salt coating of 0.10 mg/cm$^2$ and exposure to 1500° F. for 72 hours however, the alloy of the present invention displayed a weight gain of almost 3 mg/cm$^2$ . This weight gain is consistent with the formation of a protective metal oxide layer. The presence of about 2.5 weight percent molybdenum in Sample 1 increased the hot salt corrosion resistance of the alloy of the invention to hot salt corrosion relative to the prior art T-334 alloy, Sample 2. Sample 2. also showed almost no weight change for the sample without a salt coating or with a coating of 0.05 mg/cm$^2$. However, when exposed to a salt concentration of 0.10 mg/cm$^2$, Sample 2 showed a degradation of the protective oxidation layer and a weight loss of greater than 1.0 mg/cm$^2$.

The alloy of the present invention displayed a strong resistance to hot salt oxidation corrosion in this testing. The molybdenum concentration in Sample 1 increased the corrosion resistance of the alloy over the corrosion resistance of the T334 alloy, Sample 2 and similar to the corrosion resistance of the nickel-based super-alloy AL625, Sample 4.

Welded Tear Drop Testing Results

Figure 3:
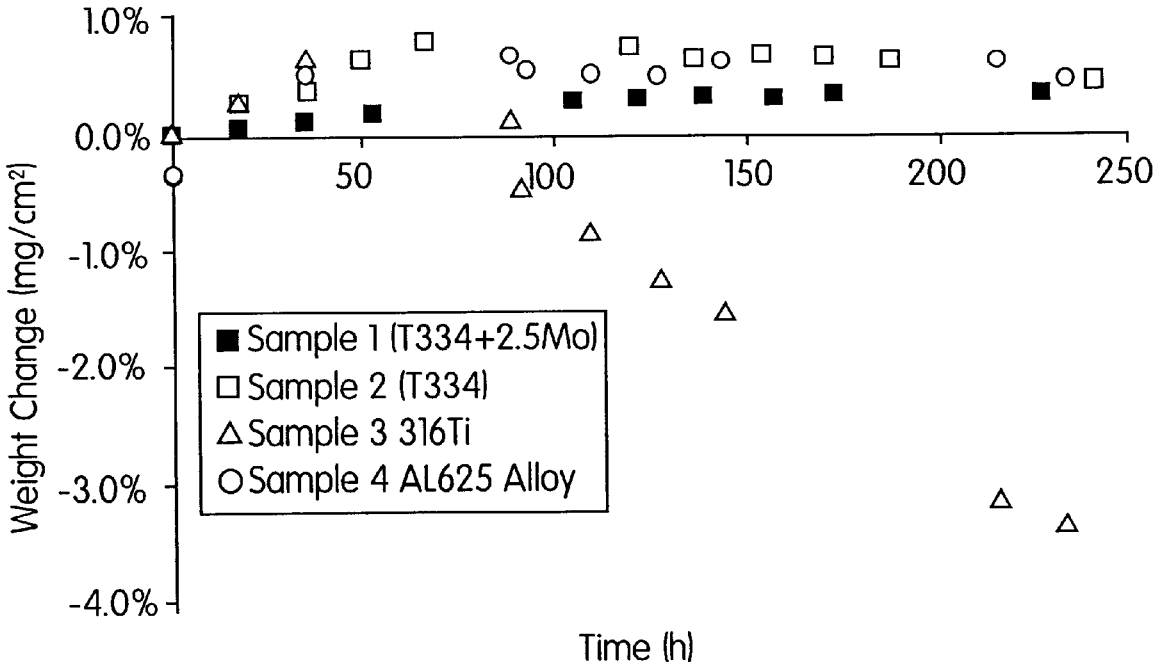
FIG. 3 is a graph of weight change data comparing the results of hot salt corrosion testing of welded teardrop samples of an alloy of the present invention (Sample 2) and prior art alloys coated with a nominal 0.10 mg/cm$^2$ salt layer and exposed to 1200° F.
Figure 4:
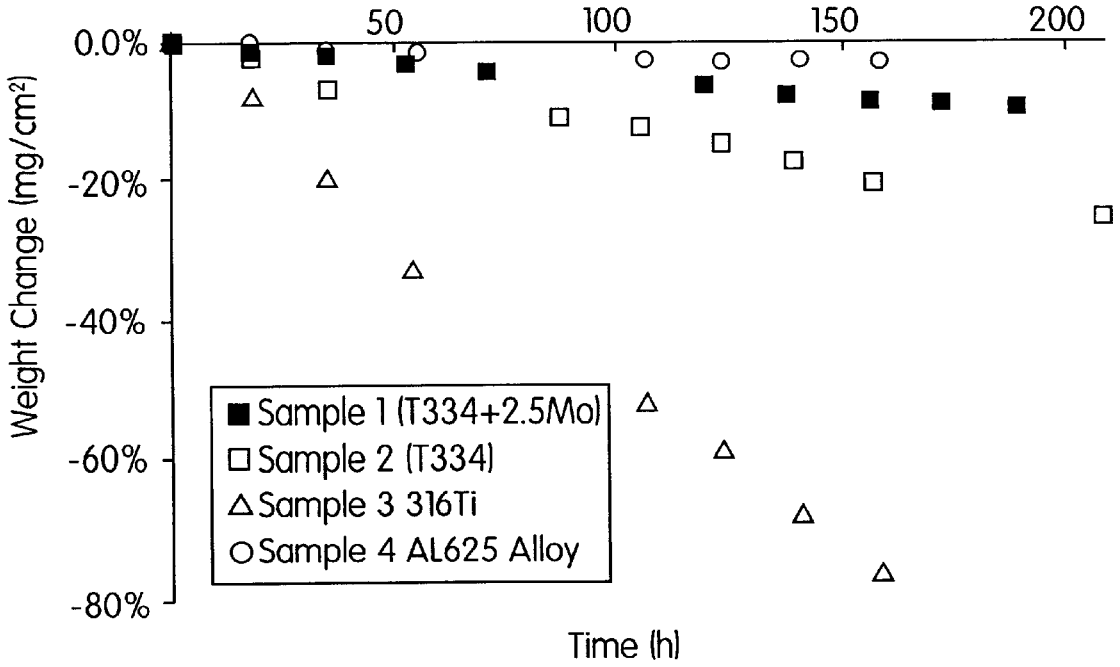
FIG. 4 is a graph of weight change data comparing the results of hot salt corrosion testing of welded teardrop samples of an alloy of the present invention (Sample 2) and prior art alloys coated with a nominal 0.10 mg/cm$^2$ salt layer and exposed to 1500° F.

The results Welded tear drop testing was consistent with the flat coupon testing. The results are reported in percentage of weight change. The coupons were weighed initially and periodically throughout the extended period of testing, over 200 hours. FIGS. 3 and 4 are graphs of the weight change data comparing the results of hot salt corrosion testing of welded teardrop samples of an alloy of the present invention (Sample 1) and prior art alloys coated with a nominal 0.10 $mg/cm^2$ salt layer and exposed to 1200° F. and 1500° F., respectively. On both figures, it can be easily recognized that T316Ti, Sample 3, again performed very poorly and proved to be an unacceptable alloy for elevated temperature corrosive environments as evidenced in FIG. 4, with greater than 70% weight loss after only 150 hours. All other tested samples were substantially equivalent in performance during exposure to 1200° F. as shown in FIG. 3.

FIG. 4 shows the results of the hot salt corrosion resistance testing of the test alloys at 1500° F. The results of this testing clearly shows the difference in resistance of the alloys. All alloys showed a weight loss after testing. The low cost alloy clearly is unsuitable for high temperature applications. The other alloys performed significantly better. The T334 alloy, Sample 2, did not perform as well as the other two alloys, AL625 and the alloy of the present invention. After 200 hours, Sample 2 had lost over 20% of its initial weight. Sample 1, the alloy of the present invention similar in composition to Sample 2 with the addition of approximately 2.5 weight percent molybdenum, performed better than Sample 2. The alloy of the present invention, Sample 1, lost less than 10% of its initial weight during the testing at 1500° F. The high cost nickel-based super-alloy AL625 performed best losing less than 5% of its initial weight after over 150 hours of testing at 1500° F.

Figure 5:
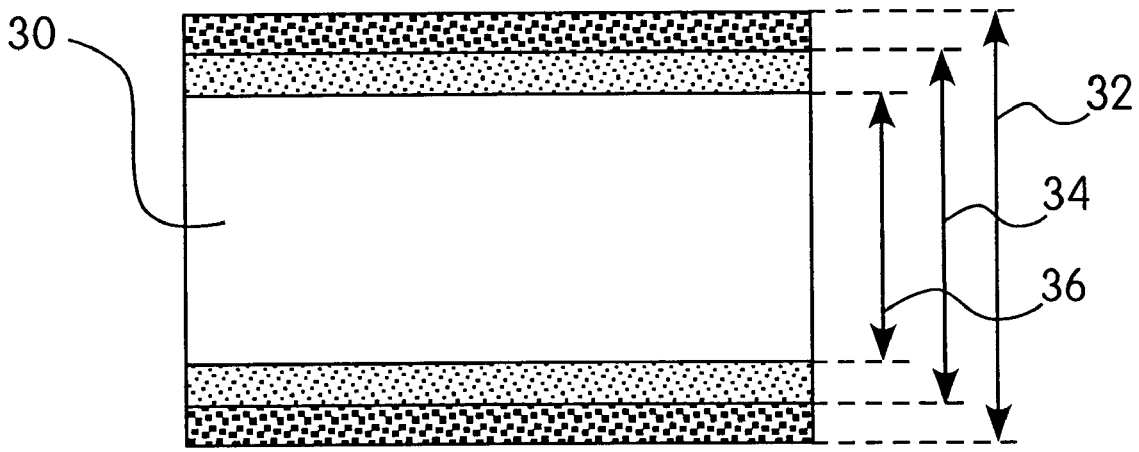
FIG. 5 is a graphical illustration of a typical corroded metal sample illustrating terms results of analysis procedure of ASTM G54—Standard Practice for Simple Static Oxidation Testing.

Weight change information alone is generally an incomplete parameter for measuring the total effect of degradation in a highly aggressive environment. Attack in highly aggressive environments, such as in hot salt oxidation corrosion, is often irregular in nature and can compromise a significantly larger portion of the cross-section of an alloy component than would appear to be affected from analysis of weight change data alone. Therefore, metal loss (in terms of percentage of remaining cross-section) were measured in accordance with ASTM-G54 Standard Practice for Simple Static Oxidation Testing. FIG. 5 illustrates the definitions of the parameters derived from this analysis. Test Sample 30 has an initial thickness, $T_o$, shown as distance 32 in FIG. 5. The percentage of metal remaining is determined by dividing the thickness of the test sample after exposure to the corrosion testing, $T_{ml}$, shown as distance 34, by the initial thickness, 32. The percentage of unaffected metal is determined by dividing the thickness of the test sample showing no signs of corrosion, $T_m$, shown as distance 36 in FIG. 4, by the initial thickness, 32. These results give a better indication than simple weight loss measurements as to when corrosion will totally degrade the metal coupon.

Figure 6:
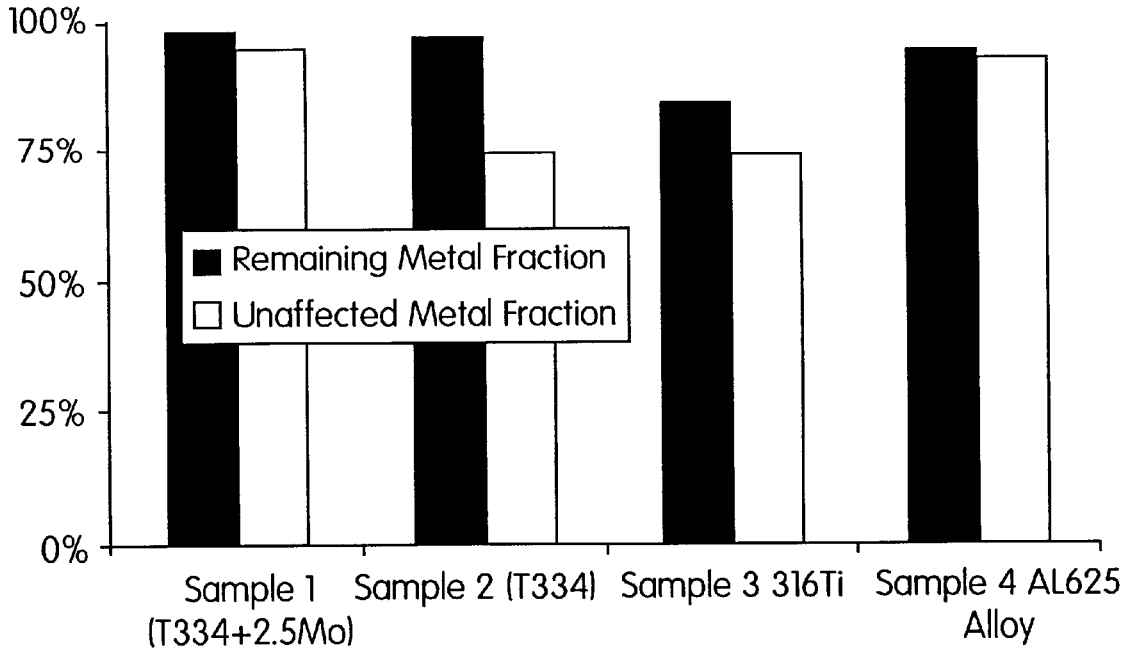
FIG. 6 is a depth of penetration graph comparing the results of measurements taken according to ASTM G54 for welded teardrop samples with a nominal 0.10 mg/cm$^2$ salt coating exposed to 1200° F. for a sample of the alloy of the present invention (Sample 2) and prior art alloys.
Figure 7:
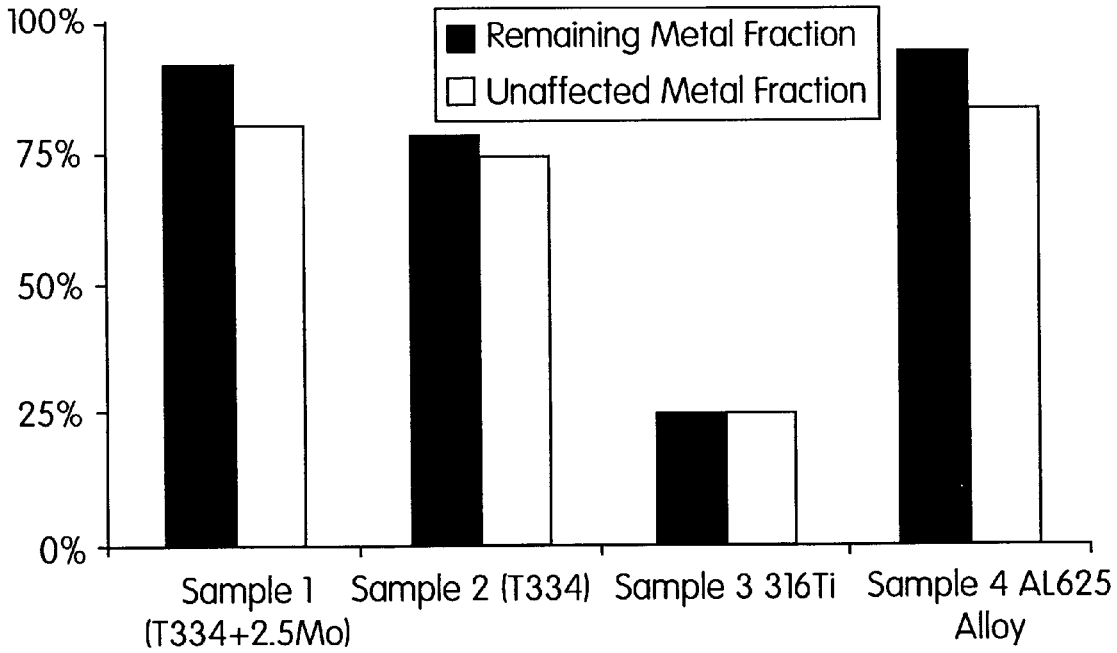
FIG. 7 is a depth of penetration graph comparing the results of measurements taken according to ASTM G54 for welded teardrop samples with a nominal 0.10 mg/cm$^2$ salt coating exposed to 1500° F. for a sample of the alloy of the present invention (Sample 2) and prior art alloys.

The results of the metallographic investigation are shown in FIGS. 6 and 7. Analysis of the low temperature alloy, T-316Ti (Sample 4), displayed significant corrosion under the both test conditions, 1200° F. and 1500° F. Only 25% of the initial cross-section remained in the T316Ti coupon after testing at 1500° F.

The other tested alloys performed well at 1200° F., greater than 90% of the initial material unaffected for Samples 1, 2, and 4. The results of analysis of the coupons after exposure to 1500° F. indicated that the higher cost nickel-base AL625 superalloy Sample 4 still experienced low percentage loss of initial thickness but began to exhibit the formation of pitting, as indicated by the difference between the percentage of remaining cross-sectional area, approximately 93%, and the percentage of unaffected metal, approximately 82%. Localized pitting of the material as indicated by the results of analysis according to ASTM-G54 procedures provides data indicating the potential for localized failure of the material. The coupon comprised of T334 alloy also showed slight pitting after exposure to 1500° F. with less than 75% of the initial material remained unaffected.

The alloy of the present invention, Sample 1, showed comparable percentage of unaffected area remaining after testing at both temperatures as the nickel-based AL625 and better results than the T334 alloy. This result indicates that the addition of 2.5 weight percent molybdenum retards the degradation and separation of the protective oxidation layer. The remaining cross-section and the percentage of unaffected area remaining after testing both greater than 75%

It is to be understood that the present description illustrates those aspects of the invention relevant to a clear understanding of the invention. Certain aspects of the invention that would be apparent to those of ordinary skill in the art and that, therefore, would not facilitate a better understanding of the invention have not been presented in order to simplify the present description. Although the present invention has been described in connection with certain embodiments, those of ordinary skill in the art will, upon considering the foregoing description, recognize that many modifications and variations of the invention may be employed. All such variations and modifications of the invention are intended to be covered by the foregoing description and the following claims.

I claim:

1. An austenitic stainless steel consisting essentially of, by weight, 19 to 23% chromium, 19 to 23% nickel, 1 to 6% molybdenum, 0 to 0.1% carbon, 0 to 1.5% manganese, 0 to 0.05% phosphorus, 0 to 0.02% sulfur, 0 to 1.0% silicon, 0.15 to 0.6% titanium, 0.15 to 0.6% aluminum, 0 to 0.75% copper, iron, and incidental impurities.

2. An austenitic stainless steel consisting essentially of, by weight, 19 to 23% chromium, 19 to 23% nickel, 2 to 4% molybdenum, 0 to 0.1% carbon, 0 to 1.5% manganese, 0 to 0.05% phosphorus, 0 to 0.02% sulfur, 0 to 1.0% silicon, 0.15 to 0.6% titanium, 0.15 to 0.6% aluminum, 0 to 0.75% copper, iron, and incidental impurities.

3. An article of manufacture, including an austenitic stainless steel consisting essentially of, by weight, 19 to 23% chromium, 19 to 23% nickel, 1 to 6% molybdenum, 0 to 0.1% carbon, 0 to 1.5% manganese, 0 to 0.05% phosphorus, 0 to 0.02% sulfur, 0 to 1.0% silicon, 0.15 to 0.6% titanium, 0.15 to 0.6% aluminum, 0 to 0.75% copper, iron, and incidental impurities.

4. An article of manufacture, including an austenitic stainless steel consisting essentially of, by weight, 17 to 23% chromium, 19 to 23% nickel, 2 to 4% molybdenum, 0 to 0.1% carbon, 0 to 1.5% manganese, 0 to 0.05% phosphorus, 0 to 0.02% sulfur, 0 to 1.0% silicon, 0.15 to 0.6% titanium, 0.15 to 0.6% aluminum, 0 to 0.75% copper, iron, and incidental impurities.

5. The article of manufacture of any of claims 3 and 4, wherein the article of manufacture is selected from an automobile, an automotive exhaust system component, a flexible connector, a heating element sheath and a gasket.

6. A method for providing an article of manufacture, the method comprising: providing an austenitic stainless steel consisting essentially of, by weight, 19 to 23% chromium, 19 to 23% nickel, 1 to 6% molybdenum, 0 to 0.1% carbon, 0 to 1.5% manganese, 0 to 0.05% phosphorus, 0 to 0.02% sulfur, 0 to 1.0% silicon, 0.15 to 0.6% titanium, 0.15 to 0.6% aluminum, 0 to 0.75% copper, iron, and incidental impurities; and fabricating the article from the austenitic stainless steel.

7. The method of claim 6, wherein the article is selected from an automotive exhaust system component, a flexible connector, a heating element sheath and a gasket.

* * * * *